United States Patent [19]

Frank et al.

[11] 4,350,018

[45] Sep. 21, 1982

[54] GAS RECOVERY SYSTEM

[75] Inventors: Karl Frank, Linz; Ewald Marnette, Windhagen, both of Fed. Rep. of Germany

[73] Assignee: Kohlensäure-Werke Rud. Buse GmbH & Co., Bad Hönningen, Fed. Rep. of Germany

[21] Appl. No.: 245,934

[22] Filed: Mar. 20, 1981

[30] Foreign Application Priority Data

Mar. 24, 1980 [DE] Fed. Rep. of Germany ..... 3011300
Jan. 29, 1981 [JP] Japan ..... 3102966

[51] Int. Cl.[3] ..... F17C 13/00
[52] U.S. Cl. ..... 62/54; 220/88 B
[58] Field of Search ..... 62/54; 220/88 B; 55/88, 55/89

[56] References Cited

U.S. PATENT DOCUMENTS

| | | | |
|---|---|---|---|
| 3,034,308 | 5/1962 | Littlewood | 62/54 |
| 3,091,098 | 5/1963 | Bowers | 62/268 |
| 3,108,446 | 10/1963 | Sohda et al. | 62/54 |
| 3,266,262 | 8/1966 | Moragne | 62/54 |
| 3,303,660 | 2/1967 | Berg | 62/54 |
| 3,369,371 | 2/1968 | Holly et al. | 62/54 |

*Primary Examiner*—Ronald C. Capossela
*Attorney, Agent, or Firm*—Watson, Cole, Grindle & Watson

[57] ABSTRACT

A method and apparatus for recovering the gases which are produced when a storage tank is operating abnormally, e.g., gases which are directly discharged through a safety valve during periods of overpressure, or else gases generated from liquids leakage outwardly therefrom, the escaping gases being cooled and liquified by heat exchange with a liquified low-boiling coolant gas, the liquified escaping gases then being passed to a collector which can have greatly reduced dimensions compared to conventional collectors.

13 Claims, 2 Drawing Figures

FIG. 1
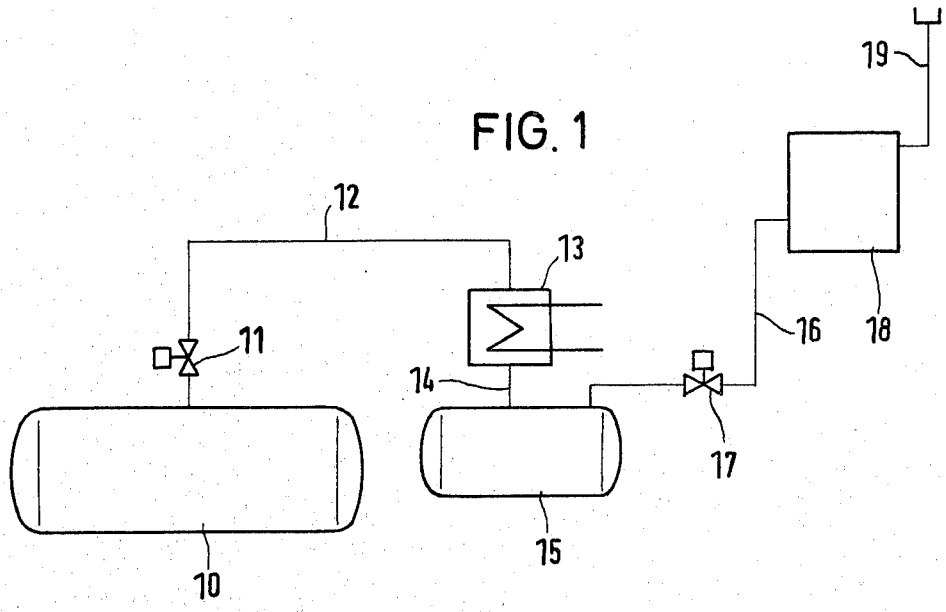
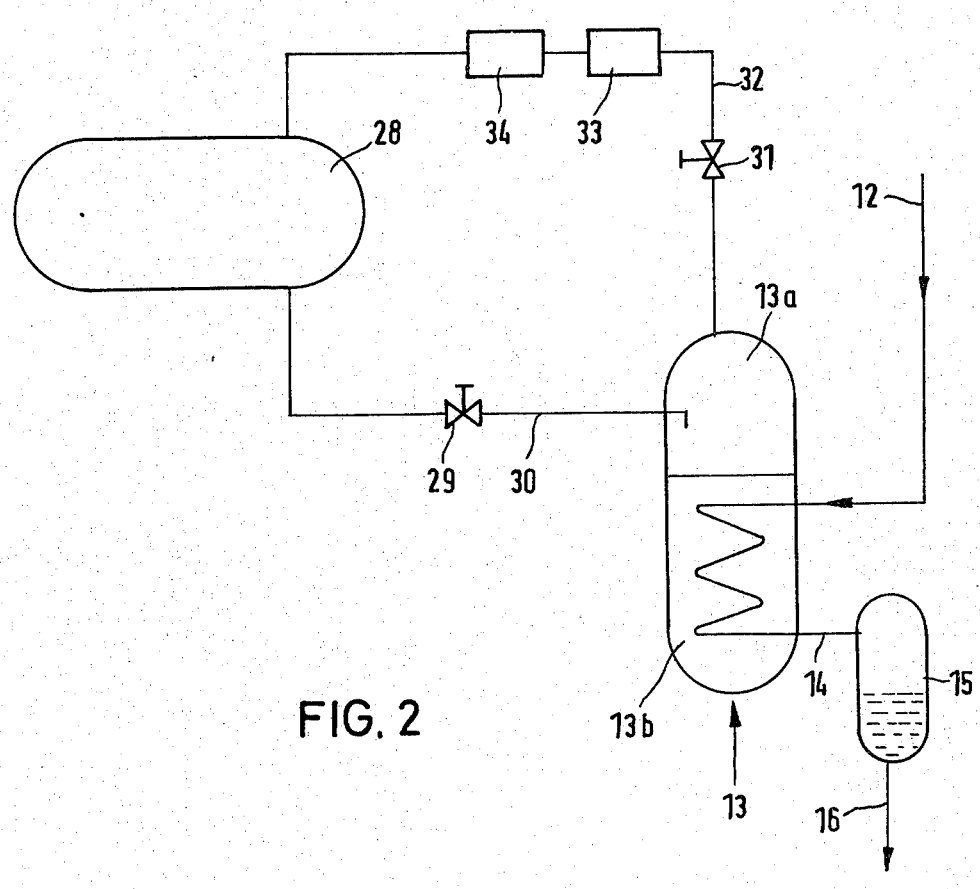
FIG. 2

GAS RECOVERY SYSTEM

BACKGROUND OF THE INVENTION

1. Field of the Invention

The present invention relates to gaseous recovery systems for storage tanks, and more particularly to systems for recovering gases which are associated with storage tanks which are improperly operating, e.g., gases which are directly discharged through a safety valve when they are under an overpressure or gases created when liquids leak outwardly therefrom.

2. The Prior Art

Storage tanks used to contain volatile liquids and gases must always be constructed to include safety devices, such as discharge lines with safety valves, so that if and when liquids leak out (and vaporize) or if overpressures occur in the tanks, e.g., due to the contained liquids and/or gases heating up to unexpectedly high temperatures, the escaping gases can be blown off. However, if the escaping gases are offensive to smell, toxic or ecologically harmful, or if they are valuable (e.g., noble gases), they cannot be simply vented to the atmosphere, but must be recovered and/or suitably disposed of.

One known way to deal with this problem is to convey the discharged gases from such storage tanks to respective collecting tanks. However, it can never be predicted in advance how long a safety valve will be open in any given system and thus how much gas will be discharged. Thus, the utilized storage tanks must be very large, which is not economical. In addition, it cannot be guaranteed that even a very large collecting tank will be sufficient to store the discharged gases in all situations.

Another procedure is to convey the discharged gases to a burn-off tube where they are burned off. However, this procedure has disadvantages too. For example, when large quantities of gases are burned, dangerously large flames can result. In addition, the gases themselves are consumed, which can be quite uneconomical.

It is thus an object of the present invention to provide a system for recovering the gases from a storage tank, i.e., either the gases discharged directly therefrom or the gases generated from leaking liquids, which system is technically simple and economical, yet will provide a high degree of safety.

SUMMARY OF THE INVENTION

According to the present invention, the gases which are associated with storage tanks which are improperly operating, e.g., gases discharged directly therefrom due to overpressures therein or the gases generated from liquids leaking outwardly therefrom, are cooled to a temperature below their boiling points such that they liquify, and the so liquified gases are then conveyed to a collecting tank. By liquifying the escaping gases, their volume is greatly reduced; thus a comparatively small collecting tank will be capable of coping with even the most serious malfunction in the operation of the storage tank, from which large volumes of gases may be discharged. The cooling can be achieved by heat exchange with a liquified low-boiling coolant gas such as, for example, liquid $CO_2$, liquid nitrogen or Freon.

Once the liquified gases have been safely conveyed to a collecting tank, they can be thereafter re-evaporated in an expansion chamber at the desired rate and finally either burned-off or, once the malfunction in the operation of the storage tank which caused the original discharge has been corrected, returned to the storage tank. Maximum safety can be assured if the expansion chamber is connected to both a burn-off tube and back to the original storage tank.

According to one desired embodiment of the invention, a portion of the liquified low-boiling coolant gas used to cool and liquify the escaping gases from the storage tank will be partially evaporated, such that the remaining liquid will undergo a significant temperature drop, thereby increasing further the effectiveness of the cooling process. The evaporated portion of the liquified low-boiling coolant gas may be used to pre-cool the escaping gases and/or be recovered by compression and liquifaction. In this way, a very effective cooling of the escaping gases from the storage tank can be achieved while using only a small amount of liquified low-boiling coolant gas.

Further aspects and features of the invention will be better understood by reference to the accompanying drawings taken in conjunction with the following discussion.

DESCRIPTION OF THE DRAWINGS

In the drawings,

FIG. 1, schematically shows one structural system which is constructed according to the present invention, and FIG. 2, schematically shows another embodiment of the invention system.

DETAILED DESCRIPTION OF THE DEFERRED EMBODIMENT

As shown in FIG. 1, a storage tank 10 which contains gases (e.g., offensively smelling gases, toxic gases, ecologically harmful gases, valuable gases, neutral gases, etc.) has an outlet line 12 connected to the upper end thereof, the outlet line 12 including a safety valve 11. The outlet line 12 leads to the inlet side of one flowpath through a typical heat exchange 13, whereas an outlet line 14 connects the outlet side of the same flowpath to a collecting tank 15 for the liquified escaping gases. The collecting tank 15 is in turn connected by an outlet line 16 having a control valve 17 to an expansion chamber 18, whereas an outlet line 19 connects the expansion chamber 18 to a burn-off tube (not shown) and/or back to the storage tank 10.

It should be noted that the second flowpath through the heat exchanger 13 is connected to a source of liquified low-boiling coolant gas, i.e., a tank containing liquid $CO_2$. The liquid $CO_2$ passing through the heat exchanger 13 will cause the escaping gases entering the heat exchanger via line 12 to change to liquids, and these liquids will then pass via line 14 to the collecting tank 15. Collecting tank 15 will be constructed to be large enough to contain considerable amounts of liquified escaping gases and will be strong enough to meet any required safety standards. It should be noted that in fact the heat exchanger 13 could be entirely eliminated, provided that the necessary cooling coils leading from the source of the liquified low-boiling coolant gas are passed through the collecting tank 15, and provided that an agitation means (not shown) is located within the collecting tank to prevent the formation of bubbles.

It should also be noted that even if the heat exchanger 13 is used in the system, the collecting tank 15 can be constructed to have cooling coils built therein or attached thereto (not shown), such that the liquified escaping gases therein can be maintained in a liquid state for as long a time as necessary.

Operation of control valve 17 will cause the liquified escaping gases to pass, when desired, to expansion chamber 18 so as to evaporate, and thereafter either be burned-off or returned to storage tank 10. Desirably, both options are employed so that when a very large quantity of escaping gases are involved, a portion can be burned-off as necessary and the rest retained in the system, thereby more or less enlarging even further the capacity of the storage tank.

Turning now to the embodiment of the invention shown in FIG. 2, an outlet line 12 connects a storage tank (not shown but similar to the storage tank 10 in FIG. 1) to a heat exchanger 13 whose outlet line 14 extends to a collecting tank 15. The outlet line 16 from the collecting tank 15 leads, for example, to an expansion chamber (not shown) similar to the expansion chamber 18 in FIG. 1. Heat exchanger 13 is divided by a perforated wall into an upper expansion portion 13*a* and a lower heat exchange portion 13*b*, the outlet line 12 being connected to a coil 12*a* which extends within the lower heat exchange portion 13*b*. On the other hand, liquified low-boiling coolant gas contained in a tank 28 is passed through a line 30 containing a valve 29 and is discharged into the upper expansion portion 13*a* of heat exchanger 13 where a portion will vaporize, whereas the remaining portion, whose temperature will be greatly reduced, will fall through the opening in the wall separating the upper expansion portion 13*a* from the lower heat exchange portion 13*b* so as to thereby cool the escaping gases flowing through the coil 12*a*. An outlet line 32 with valve 31, gas compressor 33 and condenser 34 will return coolant gas to the liquified low-boiling coolant gas tank 28.

By way of example, if the tank 28 contains liquified $CO_2$ under a pressure of 15 to 20 bars and at a temperature of $-30°$ to $-20°$ C., and this $CO_2$ is passed into the upper expansion portion 13*a* of heat exchanger 13, the pressure will drop to about 5.5 bars and the temperature will drop to about $-55°$ C. A portion of the liquid $CO_2$ will gasify while the remaining $CO_2$ liquid will drop into the lower heat exchange portion 13*b* to liquify the gas flowing through coil 12*a*. During this latter process, a portion of the liquid $CO_2$ will evaporate and return to the upper expansion portion 13*a*.

Various modifications to the embodiments shown can be made and still fall within the scope of the invention. For example, the outlet line 32 in FIG. 2 can be wrapped around the outlet line 12 to pre-cool the escaping gases flowing therethrough. Or the gaseous carbon dioxide in the upper expansion portion 13*a* could, via valve 31, be expanded further to atmospheric pressure such that its temperature will be reduced to $-70°$ C., and thereafter use this cold gas for pre-cooling.

In any event, the liquified (and possibly deactivated) escaping gas in collecting tank 15 in FIG. 2 can be discharged via outlet line 16 as is described with reference to FIG. 1.

We claim:

1. A method of recovering the gases originating from a storage tank during abnormal operation thereof, the method comprising passing the escaping gases to a heat exchanger where they are cooled and liquified by heat exchange with a liquified, low-boiling coolant gas selected from the group consisting of $CO_2$, nitrogen and Freon, and conveying the liquified escaping gases from the heat exchanger through a line to a collector tank where they can be stored.

2. The method as set forth in claim 1, including conveying the liquified escaping gases from the collector tank back to the storage tank.

3. The method as set forth in claim 1, including reevaporating the liquified escaping gases in the collector tank, and burning off at least a portion of the reevaporated escaping gases.

4. The method as set forth in claim 1, wherein the liquified low-boiling coolant gas is passed into a heat exchanger in which a portion vaporizes, the remaining liquid portion being cooled, and wherein the escaping gases from the storage tank are passed through coils located in the remaining liquid portion of the liquified low-boiling coolant gas.

5. The method as set forth in claim 4, wherein the vaporized portion of the liquified low-boiling coolant gas is compressed, liquified and recycled.

6. The method of claim 4, wherein the vaporized portion of the liquified low-boiling coolant gas is passed in heat exchange relation to the escaping gases prior to their coming in heat exchange contact with the remaining liquid portion thereof so as to pre-cool said escaping gases.

7. An apparatus for recovering the gases which originate from a storage tank during abnormal operation thereof and which are conveyed away therefrom through a safety outlet line, said apparatus including a heat exchanger, said safety outlet line being connected to said heat exchanger to deliver the escaping gases therewithin, a means for containing a liquified low-boiling coolant gas, means for conveying said liquified low-boiling coolant gas from said containing means to said heat-exchanger to cool and liquify said escaping gases therein, a separate collecting tank, means for conveying the liquified escaping gases from said heat exchanger to said separate collecting tank, an expansion chamber, and means to convey liquified gases from said collecting tank to said expansion chamber.

8. The apparatus as set forth in claim 7, wherein said means for conveying liquified escaping gases from said collecting tank to said expansion chamber includes a valve.

9. The apparatus as set for thin claim 7, including means for conveying evaporated escaping gases away from said expansion chamber.

10. The apparatus as set forth in claim 7, wherein said heat exchanger includes means forming a coil therein and wherein said means for conveying said liquified low-boiling coolant gas to said heat exchanger is connected to one end of said coil means.

11. The apparatus as set forth in claim 7, wherein said heat exchanger includes a perforated wall therein so as to define an upper expansion portion and a lower heat exchanger portion, wherein means forming a coil is positioned in said lower heat exchange portion, wherein said safety oultet line from said storage tank is connected to one end of said coil means, wherein said means for conveying liquified low-boiling coolant gas is connected to said heat exchanger at its upper expansion portion, and wherein means are provided to return evaporated coolant gas from the upper expansion portion of said heat exchanger to said containing means for said liquified low-boiling coolant gas.

12. The apparatus as set forth in claim 7, wherein said means for returning evaporated coolant gas from the upper expansion portion of said heat exchanger to said containing means for said liquified low-boiling coolant gas includes a valve, a compressor means and a condenser means.

13. The apparatus as set forth in claim 7, wherein said safety outlet line includes a safety valve.

* * * * *